US005102002A

United States Patent [19]

Whitley

[11] Patent Number: 5,102,002

[45] Date of Patent: Apr. 7, 1992

[54] BEVERAGE CUP LID

[76] Inventor: Charlie D. Whitley, 1521 Margaret, S.E., Grand Rapids, Mich. 49507

[21] Appl. No.: 641,783

[22] Filed: Jan. 16, 1991

[51] Int. Cl.[5] ..... B65D 43/18; B65D /51/14

[52] U.S. Cl. ..... 220/336; 220/703; 220/287; 220/375

[58] Field of Search ..... 220/335, 336, 281, 287, 220/375, 90.2, 90.4, 90.6, 323, 326, 262, 264

[56] References Cited

U.S. PATENT DOCUMENTS

| | | | |
|---|---|---|---|
| 1,424,519 | 8/1922 | Richardson | 220/908 X |
| 2,552,397 | 5/1951 | Bretney | 220/336 X |
| 2,886,393 | 5/1959 | Tonning et al. | 220/336 X |
| 3,352,445 | 11/1967 | Cochin | 220/336 X |
| 3,556,341 | 1/1971 | Rains | 220/90.4 |
| 3,731,837 | 5/1973 | Platts et al. | 220/336 X |
| 4,127,211 | 11/1978 | Zerbey | 220/212 |
| 4,450,974 | 5/1984 | Winden | 220/336 X |
| 4,712,704 | 12/1987 | Ramsey et al. | 220/254 |
| 4,842,158 | 6/1989 | Reyes, Jr. | 220/94 R |
| 4,872,577 | 10/1989 | Smith | 220/85 CH |

*Primary Examiner*—Stephen Marcus
*Assistant Examiner*—Vanessa Caretto
*Attorney, Agent, or Firm*—Richard C. Litman

[57] ABSTRACT

A reusable lid for a beverage cup or can [10] includes a round flat cover plate [20] which covers the rim of the cup to prevent dirt and insects from entering. The cover plate is held in place by a rubber torsion rod [30] which attaches perpendicularly to the plate near the edge. The other end of the rod is attached to a suction cup [40] which holds to the side of the cup. The plate is normally in a position to close the cup; it is shown displaced to one side in the drawing, as when drinking. The plate is pushed to one side with a finger. The rubber rod returns the plate to the closed position upon release. A strap with VELCRO buckle, or an elastic band around the cup, may substitute for the suction cup. The torsion rod may also be permanently attached to the cup.

12 Claims, 1 Drawing Sheet

BEVERAGE CUP LID

FIELD OF THE INVENTION

The present invention relates to operably removable covers for cups, mugs, glasses and the like.

DESCRIPTION OF THE PRIOR ART

The idea of a cup for drinking beverages is very old, and almost equally old is the idea of a cover. Cup covers are used for the same reasons that covers are used on cooking pots: to maintain temperature and to keep out dirt and insects.

Some ceramic coffee mugs include a removable cover to keep the drink within hot by preventing the escape of vapor. These covers are quite effective although they are not insulated. The same idea is seen on the familiar disposable coffee cups, typically of styrene foam, which employ a snap-on lid of thin sheet plastic. These lids are awkward because the lid must be removed and placed to one side, or held the other hand, while drinking. They are also prone to dripping.

Also familiar is the beer stein with a lid hinged to swing open about a hinge axis tangent to the rim of the stein. The hinge is normally placed directly above the handle of the stein, and a catch is provided for operating the lid with the thumb of the hand holding the handle. This sort of lid is liable to hit the face when drinking if the lid is not correctly positioned. The lid is also prone to banging to either a closed or fully open position since it swings through a gravity differential.

Fournier, in U.S. Pat. No. 4,331,255, teaches a snap-on double plastic lid for drinking coffee and the like from a styrene foam cup. The lid is intended to prevent burning of the lips if the beverage is sipped while driving. The lid is formed from a single piece of plastic in the manner of the ordinary throw-away lid. It includes two adjoining disc sections. The thin joining region is bendable so that one disc can fold over onto the first. One disc becomes the inner lid, and the other becomes the outer lid. Their rims are shaped to snap together. The inner lid contains several small holes to admit coffee into the space between the two lids. The outer lid is unbroken except for one tab which removes for drinking. This tab is the usual sort found on disposable lids for styrene foam cups. The double lid prevents lip burns by only slowly releasing coffee to the outer tab opening through the several holes. This lid does not cover the cup sufficiently to prevent dirt and insects from entering, as the inner holes are large enough to admit some insects, and, in any case, insects an d dirt can easily lodge between the two lids.

Lay, et al., in U.S. Pat. No. 4,735,333 show an insulated mug similar to a beer stein which is sized to hold an aluminum can within. The insulated lid swings off by thumb action, allowing the user to sip directly from the can. Stuber, et al., in U.S. Pat. No. 4,927,047, show an insulated mug which is very similar to that of Lay, et al. but has a rubber band to close the lid.

Reyes, Jr., in U.S. Pat. No. 4,842,158, discloses handles with operable caps for attaching to disposable two and three-liter plastic bottles. The operable caps screw onto the neck to replace the original cap; they are similar to the beer stein cap in structure and operation. The handle is attached to the body of the plastic bottle with straps which are fastened with VELCRO. The handle reaches from the straps up to the cap.

Cerrone, Jr., in U.S. Pat. No. 4,869,389, shows snap-on lids for beverage cans and glasses with a fly-screen type perforated area to prevent insect entry to the beverage. While these prevent actual entry of insects, they do nothing to prevent insects such as flies from walking on the drinking surfaces, nor do they prevent dirt from entering the beverage or accumulating on the surfaces which touch the user's lips.

None of the above inventions and patents, taken either singly or in combination, is seen to describe the instant invention as claimed.

The prior art is not seen to disclose a movable lid for a cup which is suitable for maintaining temperature and for preventing insect access to the beverage, where the lid moves within a horizontal plane. Nor does it disclose a lid which includes built-in friction.

Accordingly, one object of the present invention is a lid for a beverage cup, bowl, can or like container which pivots horizontally.

Another object is a lid with built-in friction to avoid banging.

Still another object is a lid which is self-closing and which can be attached to a variety of cups, cans, etc.

A final object is a lid which prevents both dirt and insects from contacting either the beverage within a cup or the drinking surfaces which contact the lips, and which also keeps beverages hot or cold.

These and other objects of the present invention will become readily apparent upon further review of the following specification and drawings.

SUMMARY OF THE INVENTION

The present invention is a reusable lid for a beverage cup. It includes a round flat cover plate which covers the rim of a cup to prevent dirt and insects from entering. The lid is held in place by a rubber torsion rod which attaches perpendicularly to the plate near the edge. The other end of the rod is attached to a suction cup which holds to the side of the cup. The plate normally closes the cup. For drinking, the plate is pushed to one side with a finger. The twisted rubber rod returns the plate to the close position upon release.

A strap with VELCRO buckle, or an elastic band around the cup, may substitute for the suction cup. The rubber rod may also be permanently attached to the cup.

The lid is designed to be microwave safe.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
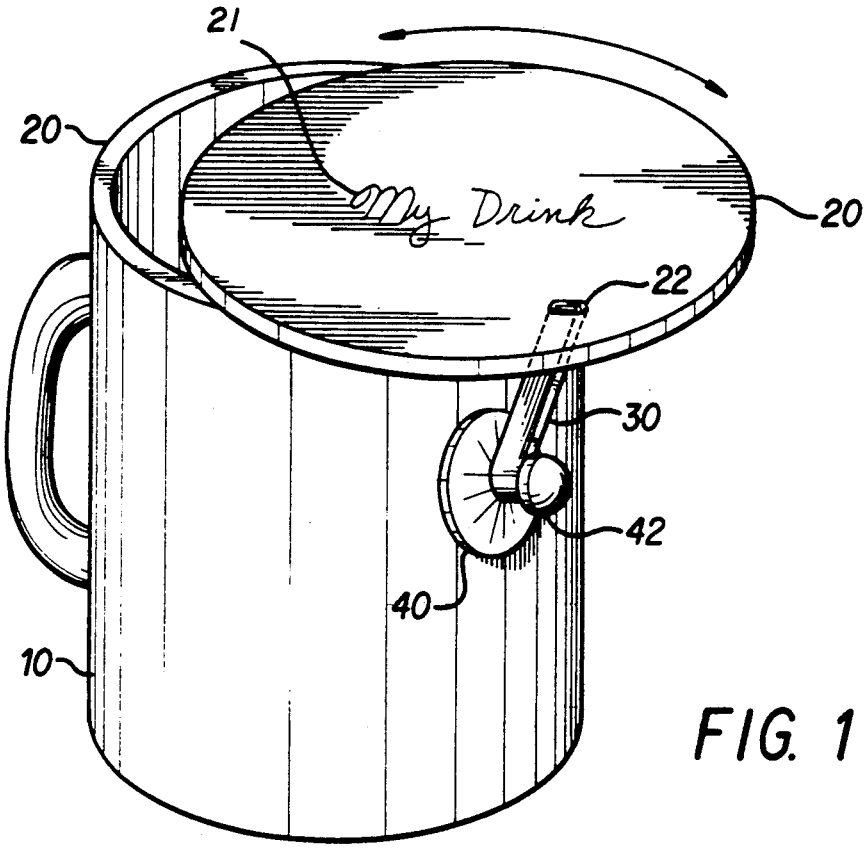
FIG. 1 is a perspective view of one embodiment of the present invention, showing the lid cover plate, the torsion rod, and the suction cup attached to a cup.

The present invention is shown in FIG. 1 in a first embodiment. A beverage cup 10 has a rim 12 which describes a circle lying in a plane. A circular, planar cover plate 20 is sized to cover the rim 12 and thereby prevent insects and dirt from entering the cup 10 when the cover plate 20 is centered on the axis of the cup 10. In the drawing, the plate 20 is shown displaced in a horizontal plane to one side to uncover the rim 12. The plate 20 is preferably made of eighth inch plastic sheet. When in the closed or fully overlying position, the cover plate not only protects the contents of the cup from insects or the like but also, it will be appreciated that the temperature of the cup contents will be further maintained when the plate 20 is closed. Thus, it follows that a certain degree of insulation will be provided to any cup contents when the plate is closed as the material of the plate seals off the otherwise exposed cup top opening from the ambient atmosphere. Obviously, the insulative value of the closed plate will vary according to the composition employed for the cover plate 20.

(Both the cup rim 12 and the cover plate 20 may be non-circular. However, the rim 12 must lie generally in a plane if the invention is to work with a flat cover plate 20. Also, the plate 20 may be made a non-planar section of a large sphere when the rim is circular; the spherical surface will then seal against the rim in various rim positions.)

The plastic material of the plate 20 is preferably of a type which can be microwaved for short periods. The lid can then be used to cover pots and bowls in a microwave oven to prevent boiling over. However, the plate should not be left in a microwave for long periods, as it may become hot and burn the fingers.

Indicia 21 may be disposed upon the upper surface of the plate.

A hole 22 through the plate 20 near the circumference of the plate accepts a torsion rod member 30. The torsion rod is preferably of rubber or some similar elastic material which can act as a spring. The torsion rod is press fit to the hole 22 so the end of the rod cannot rotate in the hole. Other means of fixing the rod 30 to the hole 22 are also possible.

The lower end of the elastic torsion rod 30 is fixed to the cup 10 by some means. In the embodiment of FIG. 1, this means is a suction cup 40 pressed onto the cup's outer surface to stick there and support the torsion rod 30 and cover plate 20. The torsion rod lower end is fixed to the suction cup by a metal clip 42.

In use, the plate 20 is pushed to one side by a finger of the hand holding the cup, and the average is drunk. When the finger pressure is released, the torsion in the rod will force the plate to rotate back to its resting (unstressed) position, which is the closed position (not shown) where the plate covers the rim of the cup.

With the rubber rod shown in the drawing, the plate may of course also be moved upward in the manner of a beer stein cover to uncover the cup rim. The rod can be bent or twisted, or both bent and twisted. The invention may also use, in place of the elastic rod, a coil spring which like the rubber rod can stretch, twist, and bend. Also, a device which allows only twisting, such as mechanical hinge with a hinge axis perpendicular to the cover plate, is within the scope of the invention.

The present invention is unlike devices disclosed in the prior art in that the contact of the lid with the rim of the cup while the lid is moved away from its closed position damps the motion of the lid. Thus, the lid will not be prone to banging as is a beer stein-type lid. Nor will it oscillate when released from a position to one side.

Figure 2:
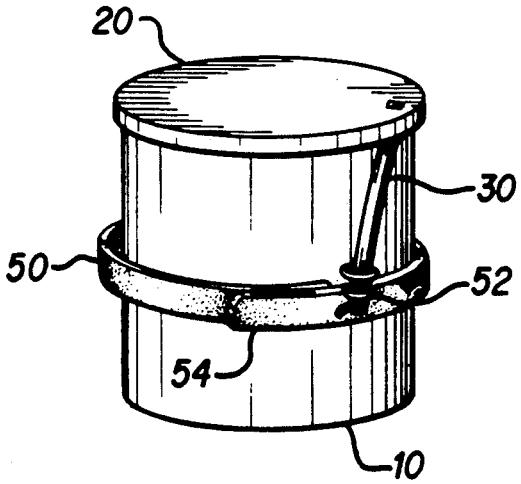
FIG. 2 is perspective view of an alternate embodiment employing a strap in place of the suction cup.

An alternate embodiment is shown in FIG. 2. Here the suction cup attachment of FIG. 1 is replaced with a belt or band 50 encircling the cup 10. The lower end of the torsion rod 30 is attached to the belt 50 by metal clips 52. The belt 50 is preferably elasticized to grip the cup 10. Friction material may be included on the inside of the belt 50 for a better grip. To adapt to cups of different diameters, the belt may be fastened with VELCRO or equivalent buckling means 54.

Figure 3:
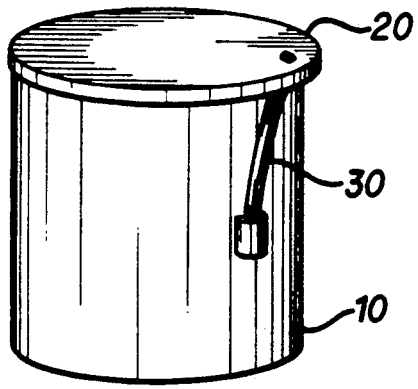
FIG. 3 shows the invention built into a cup rather than removably attached.

In a third embodiment, the attachment of the torsion rod 30 to the cup 10 is permanent. This embodiment is shown in FIG. 3. In this case the cup may be considered an element of the invention.

It is to be understood that the present invention is not limited to the sole embodiment described above, but encompasses any and all embodiments within the scope of the following claims. In particular, the invention may be used with any sort of beverage container for drinking.

Above, and in the following claims, "cup" means a cup, mug, glass, bowl, or other open container, whether having a handle or not, and unrestricted as to shape. "Cup" herein will also refer to containers with partially restricted mouths, such as mustache cups and ordinary steel or aluminum beverage cans.

Also, the phrase "elongated member of elastic material" includes coil springs, and any other element which acts equivalently to a rubber rod, such as a combination of hinges.

I claim:

1. A finger openable lid for closing a beverage cup, said cup of the type having a rim defining a plane, said lid comprising:

a cover plate sized and shaped to cover said rim in a closed position to prevent insects and dirt from entering said cup, said cover plate when in said closed position generally coplanar with said plane of said rim;

a hinge joining said cover plate to said cup, said hinge having an axis of relative rotation perpendicular to said plane of said rim, said cover plate is slidably displaceable from said closed position to an open position wherein said cover plate is generally coplanar with said plane of said rim and is displaced from said rim for drinking access to said rim, said hinge including an elongated member of elastic material, said member having an upper end attached to said cover plate and a lower end attached to said cup, said elongated member generally perpendicular to said plane of said rim when said cover plate is in said closed position, said elongated member so attached to said cover plate and to said cup that elastic stresses in said elongated member are minimized when said cover plate is in said closed position, whereby, said member may elastically deform in torsion when said cover plate is moved away from said closed position to said open position, and, said cover plate will be resiliently urged to return to said closed position by increased stress in said member.

2. A lid as in claim 1 wherein said cover plate is planar.

3. A lid as in claim 1 wherein said cover plate is insulating.

4. A lid as in claim 1 wherein said cover plate bears indicia on a upper surface distal said rim.

5. A finger openable lid for closing a beverage cup, said cup of the type having an outside surface and having a rim defining a plane, said lid comprising:

a cover plate sized and shaped to cover said rim in a closed position to prevent insects and dirt from entering said cup, said cover plate when in said closed position generally coplanar with said plane of said rim;

a hinge joining said cover plate to said attachment means, said hinge having an axis of relative rotation perpendicular to said plane of said rim, said cover plate slidably displaceable from said closed position to an open position wherein said cover plate is generally coplanar with said plane of said rim and is displaced from said rim for drinking access to said rim, said hinge including an elongated member of elastic material, said member having an upper end attached to said cover plate and a lower end attached to said attachment means, said elongated member generally perpendicular to said plane of said rim when said cover plate is in said closed position, said elongated member so attached to said cover plate and to said attachment means that elastic stresses in said elongated member are minimized when said cover plate is in said closed position, whereby, said member may elastically deform in torsion when said cover plate is moved away from said closed position to said open position, and, said cover plate will be resiliently urged to return to said closed position by increased stress in said member.

6. A lid as in claim 5 wherein said cover plate is planar.

7. A lid as in claim 5 wherein said cover plate is insulating.

8. A lid as in claim 5 wherein said cover plate bears indicia on a upper surface distal said rim.

9. A lid as in claim 5 wherein said attachment means includes a band encircling said cup.

10. A lid as in claim 9 wherein said band includes bend end joining means.

11. A lid as in claim 9 wherein said band is elastic for gripping said cup.

12. A finger openable lid for closing a beverage cup, said cup of the type having an outside surface and having a rim defining a plane, said lid comprising:

a cover plate sized and shaped to cover said rim in a closed position to prevent insects and dirt from entering said cup, said cover plate when in said closed position generally coplanar with said plane of said rim;

attachment means for removably attaching said lid to said cup, said attachments adapted to removably fasten to said outside surface of said cup;

said attachment means including a rubber suction cup, a hinge joining said cover plate to said rubber suction cup, said hinge having an axis of relative rotation perpendicular to said plane of said rim, whereby said cover plate may slide from said closed position to an open position wherein said cover plate is generally coplanar with said plane of said rim and is displaced from said rim for drinking access to said rim.

* * * * *